US007536867B2

(12) United States Patent
Kaga et al.

(10) Patent No.: US 7,536,867 B2
(45) Date of Patent: May 26, 2009

(54) AUGER-TYPE ICE-MAKING MACHINE

(75) Inventors: Shinichi Kaga, Toyoake (JP); Akihiko Hirano, Toyoake (JP); Naoshi Kondou, Toyoake (JP)

(73) Assignee: Hoshizaki Denki Kabushiki Kaisha, Toyoake-Shi (JP)

( * ) Notice: Subject to any disclaimer, the term of this patent is extended or adjusted under 35 U.S.C. 154(b) by 284 days.

(21) Appl. No.: 10/574,518

(22) PCT Filed: Sep. 24, 2004

(86) PCT No.: PCT/JP2004/014426

§ 371 (c)(1),
(2), (4) Date: Apr. 3, 2006

(87) PCT Pub. No.: WO2005/033547

PCT Pub. Date: Apr. 14, 2005

(65) Prior Publication Data

US 2007/0006606 A1 Jan. 11, 2007

(30) Foreign Application Priority Data

Oct. 3, 2003 (JP) ..... 2003-345103

(51) Int. Cl.
*F25C 1/14* (2006.01)

(52) U.S. Cl. ..... 62/227; 62/228.4; 62/354

(58) Field of Classification Search ..... 62/215, 62/226–227, 228.1, 228.4, 354
See application file for complete search history.

(56) References Cited

U.S. PATENT DOCUMENTS 3,769,809 A * 11/1973 Robinson et al. ..... 62/137

(Continued)

FOREIGN PATENT DOCUMENTS

EP 1 437 565 A1 7/2004

(Continued)

OTHER PUBLICATIONS

Relevant portion of International Search Report of corresponding PCT Application PCT/JP2004/014426.

*Primary Examiner*—William E Tapolcai
(74) *Attorney, Agent, or Firm*—Rossi, Kimms & McDowell, LLP

(57) ABSTRACT

An auger type ice making machine is provided with a freezing cylinder (21) into which water for making ice is supplied, an ice-scraping auger (23) for scraping ice formed on the inner surface of the freezing cylinder (21), and an auger motor (25) for driving the ice-scraping auger (23). An freezing apparatus (10) has a compressor (11) driven by a motor (16), circulating refrigerant discharged from the compressor (11) through a condenser (12), a dryer (13), a constant pressure expansion valve (14), and an evaporator (15) provided on the outer peripheral surface of the freezing cylinder (21). At the outlet of the evaporator (15) there is provided a temperature sensor (41) for sensing refrigerant temperature. A controller (42) controls the rotational speed of the motor (16) through an inverter circuit (43) such that the sensed refrigerant temperature is equal to a specified refrigerant temperature, allowing the freezing apparatus (10) to keep ice-making performance thereof. As a result, the auger type ice making machine can keep ice-making performance regardless of changes in ambient temperature or water temperature, securing stable ice generation and consistent quality of ice.

20 Claims, 6 Drawing Sheets

U.S. PATENT DOCUMENTS

| | | | | |
|---|---|---|---|---|
| 5,669,226 | A * | 9/1997 | Kurahashi et al. | 62/227 |
| 6,109,048 | A * | 8/2000 | Kim | 62/228.4 |
| 6,434,964 | B1 * | 8/2002 | Tomiyama et al. | 62/354 |

FOREIGN PATENT DOCUMENTS

| | | | |
|---|---|---|---|
| JP | 8-110136 | A | 4/1996 |
| JP | 9-4950 | A | 1/1997 |
| JP | 2000-356441 | A | 12/2000 |
| JP | 2001-263889 | A | 9/2001 |
| JP | 2002-323278 | A | 11/2002 |
| JP | 2003-161553 | A | 6/2003 |
| WO | WO 03/025478 | A1 | 3/2003 |

* cited by examiner

AUGER-TYPE ICE-MAKING MACHINE

This application is a U.S. National Phase Application of PCT International Application PCT/JP2004/014426 filed on Sep. 24, 2004.

TECHNICAL FIELD

The present invention relates to an auger type ice making machine in which ice formed on the inner surface of a freezing cylinder having an evaporator on its outer peripheral surface is scraped off and extruded by an ice scraping auger.

BACKGROUND ART

As shown in Japanese Laid-Open No. 2000-356441, for example, there is a well-known auger type ice making machine provided with a freezing cylinder which has an evaporator on its outer peripheral surface and into which water used for making ice is supplied, wherein the freezing cylinder is cooled by a freezing apparatus in which refrigerant discharged from a compressor driven by a motor is circulated through a condenser, a dryer and the evaporator to form ice on the inner surface of the freezing cylinder, the thus-formed ice being scraped off and extruded by an ice-scraping auger driven by an auger motor. Such auger type ice making machine has a thermal expansion valve on the upstream side of the evaporator. The thermal expansion valve is designed to open more, with increase in temperature of the refrigerant in the downstream side of the evaporator, to control the amount of refrigerant flowing into the evaporator on the basis of the refrigerant temperature at the evaporator outlet, thereby securing specified performance in making ice.

In the above scheme where the refrigerant flow is controlled on the basis of the refrigerant temperature at the evaporator outlet, when ambient temperature or water temperature is high, the performance of the freezing apparatus (particularly, the compressor) decreases. Since a significant heat load is applied to the freezing cylinder, in addition, the refrigerant pressure of the downstream side of the thermal expansion valve increases, and so does the evaporative temperature of the refrigerant in the evaporator. Although water temperature in the freezing cylinder is near 0° C. during stable operation, relatively high evaporative temperature of the refrigerant and water temperature cause decreased amount of heat exchange of the freezing cylinder, resulting in decreased amount of ice manufactured per unit of time. When ambient temperature or water temperature is low, on the other hand, the performance of the freezing apparatus (particularly, the compressor) increases. Since the heat load applied to the freezing cylinder decreases, in addition, the refrigerant pressure of the downstream side of the thermal expansion valve decreases, and so does the evaporative temperature of the refrigerant in the evaporator. In this case, relatively low evaporative temperature of the refrigerant and water temperature cause increased amount of heat exchange of the freezing cylinder, resulting in increased amount of ice manufactured per unit of time.

Such conventional auger type ice making machine which uses the thermal expansion valve to control the refrigerant flow on the basis of the refrigerant temperature at the evaporator outlet causes a problem that the auger type ice making machine is failure-prone due to the following reasons: the auger type ice making machine designed to have sufficient performance in making ice at high ambient temperature and water temperature has excessive performance in making ice at low ambient temperature and water temperature, resulting in heavy load applied to an auger motor for driving an ice-scraping auger, significant thrust exerted on the blade of the ice-scraping auger at the scraping of ice formed on the inner surface of the freezing cylinder, and ice clogging caused by increased resistance applied to the blade of the auger at the passage of ice.

In addition to the above-described scheme, there is another well-known scheme in which a constant pressure expansion valve that keeps refrigerant on the output side at a constant pressure is provided on the upstream side of the evaporator, thereby controlling the refrigerant flow on the basis of the refrigerant pressure at the evaporator inlet. In this scheme, when ambient temperature or water temperature is high, the performance of the freezing apparatus (particularly, the compressor) decreases. Since a significant heat load is applied to the freezing cylinder, in addition, the refrigerant pressure at the evaporator inlet (downstream side of the constant pressure expansion valve) increases, and so does the evaporative temperature of the refrigerant. Because the constant pressure expansion valve is designed to maintain the pressure of the downstream side thereof, the amount of the refrigerant to be supplied to the evaporator is reduced. As a result, a phenomenon in which liquid refrigerant does not reach to the evaporator outlet occurs, hindering the function of the freezing cylinder to decrease the performance in making ice. When ambient temperature or water temperature is low, on the other hand, the performance of the freezing apparatus (particularly, the compressor) increases. Since the heat load applied to the freezing cylinder decreases, in addition, the refrigerant pressure at the evaporator inlet (downstream side of the constant pressure expansion valve) decreases, and so does the evaporative temperature of the refrigerant. Because the constant pressure expansion valve is designed to maintain the pressure of the downstream side thereof, the amount of the refrigerant to be supplied to the evaporator increases. As a result, there is a phenomenon in which even though liquid refrigerant has reached to the evaporator outlet, the constant pressure expansion valve keeps supplying refrigerant, resulting in refrigerant liquid back to the compressor.

In such conventional auger type ice making machine which uses the constant pressure expansion valve to control the refrigerant flow on the basis of the refrigerant pressure at the evaporator inlet, the constant pressure value of the constant pressure expansion valve is determined in consideration of the difference between the evaporative temperature of refrigerant and the temperature of the freezing cylinder as well as the balance between the range to which liquid refrigerant reaches and refrigerant liquid back to the compressor. As described above, when ambient temperature or water temperature is low, however, such freezing apparatus using the constant pressure expansion valve tends to present a problem of refrigerant liquid back to the compressor. In addition, such freezing apparatus also causes a problem that sufficient performance in making ice cannot be delivered when ice grows in demand, i.e., when ambient temperature or water temperature is high.

DISCLOSURE OF THE INVENTION

The present invention was accomplished to solve the above-described problems, and an object thereof is to provide an auger type ice making machine which resolves a problem of failure-proneness exhibited by auger type ice making machines which use a thermal expansion valve and problems of liquid back and performance at high ambient or water temperature exhibited by auger type ice making machines which use a constant pressure expansion valve, and varies the ice-making performance as demanded.

In order to achieve the above-described object, it is a feature of the present invention to provide an auger type ice making machine provided with a freezing cylinder which has an evaporator on its outer peripheral surface and into which water used for making ice is supplied, an ice-scraping auger for scraping ice formed on an inner surface of the freezing cylinder, an auger motor for driving the ice-scraping auger, a freezing apparatus which includes a compressor, a condenser and the evaporator and circulates refrigerant discharged from the compressor through the condenser and the evaporator to cool the freezing cylinder, and a motor which drives the compressor, the auger type ice making machine comprising pressure regulating means for keeping the pressure of refrigerant to be supplied to the evaporator at a specified low pressure; an outlet temperature sensor for sensing refrigerant temperature at an outlet of the evaporator; and motor controlling means for controlling the rotational speed of the motor in response to the refrigerant temperature at the outlet of the evaporator sensed by the outlet temperature sensor and thereby keeping the refrigerant temperature at the outlet of the evaporator at a specified refrigerant outlet temperature.

In this case, the pressure regulating means may comprise, for example, a constant pressure expansion valve which is interposed between the condenser and the evaporator, and whose opening is controlled and changed in response to the refrigerant pressure on the downstream side of the interposed position. Furthermore, the pressure regulating means may comprise a variable control valve being interposed between the condenser and the evaporator, the opening of the variable control valve being electrically controlled and changed; a pressure sensor for sensing refrigerant pressure at an inlet of the evaporator; and opening controlling means for controlling the opening of the variable control valve in response to the refrigerant pressure sensed by the pressure sensor and thereby keeping the pressure of refrigerant to be supplied to the evaporator at a specified low pressure. Considering that the refrigerant temperature and the refrigerant pressure at the inlet of the evaporator are inevitably defined by each other, in addition, the pressure sensor may be replaced with an inlet temperature sensor for sensing refrigerant temperature at the inlet of the evaporator. In this case, the opening controlling means controls the opening of the variable control valve in response to the refrigerant temperature sensed by the inlet temperature sensor and thereby keeps the pressure of refrigerant to be supplied to the evaporator at the specified low pressure.

According to the feature of the present invention configured as described above, at high ambient temperature or high water temperature, since the freezing apparatus (particularly, the compressor) decreases in performance, and a significant heat load is applied to the freezing cylinder, the constant pressure expansion valve squeezes the valve so that the refrigerant pressure (refrigerant temperature) at the inlet of the evaporator is kept constant. As a result, the amount of refrigerant flowing into the evaporator is reduced. More specifically, the area in the evaporator where liquid refrigerant remains, i.e., the area where the refrigerant can make ice in the evaporator is reduced, so that the degree of superheat of the refrigerant grows to increase the refrigerant temperature at the outlet of the evaporator. On this occasion, since the motor controlling means controls the rotational speed of the motor so that the refrigerant temperature at the outlet of the evaporator is kept at the specified refrigerant outlet temperature, in other words, the motor controlling means controls to increase the rotational speed of the motor, the amount of refrigerant in the evaporator to be sucked into the compressor increases in spite of the refrigerant pressure and refrigerant temperature at the inlet of the evaporator being kept constant, so that the amount of refrigerant flowing into the evaporator through the condenser is increased. As a result, the area where refrigerant can make ice in the evaporator increases, so that this freezing apparatus can keep specified performance in making ice even in high ambient temperature or high water temperature.

At low ambient temperature or low water temperature, on the other hand, since the freezing apparatus (particularly, the compressor) increases in performance, and a heat load applied to the freezing cylinder is light, the constant pressure expansion valve is opened so that the refrigerant pressure (refrigerant temperature) at the inlet of the evaporator is kept constant. As a result, the amount of refrigerant flowing into the evaporator increases to increase the area in the evaporator where liquid refrigerant remains, i.e., the area where the refrigerant can make ice in the evaporator, so that the degree of superheat of the refrigerant is reduced to decrease the refrigerant temperature at the outlet of the evaporator. On this occasion, since the motor controlling means controls the rotational speed of the motor so that the refrigerant temperature at the outlet of the evaporator is kept at the specified refrigerant outlet temperature, in other words, since the motor controlling means controls to decrease the rotational speed of the motor, the amount of refrigerant in the evaporator to be sucked into the compressor decreases in spite of the refrigerant pressure and refrigerant temperature at the inlet of the evaporator being kept constant, so that the amount of refrigerant flowing into the evaporator through the condenser decreases. As a result, the area where refrigerant can make ice in the evaporator decreases, so that this freezing apparatus can keep specified performance in making ice even in low ambient temperature or low water temperature.

As described above, the feature of the present invention enables the auger type ice making machine, in spite of a simple configuration that controls the rotational speed of the motor in response to refrigerant temperature at the outlet of the evaporator, to maintain specified ice-making performance of the freezing apparatus regardless of changes in ambient temperature or water temperature, resolving problems of liquid back to the compressor and failure-proneness. As described above, in addition, since the evaporative temperature of the refrigerant in the evaporator is kept constant, the quality of ice to be generated is also kept consistent. According to the feature of the present invention, furthermore, since the area where refrigerant can make ice increases to increase the ice-making performance of the refrigerant apparatus as the specified refrigerant outlet temperature in the evaporator is decreased, the ice-making performance of the freezing apparatus may be left variable by allowing a user to arbitrarily set the refrigerant outlet temperature.

Another feature of the present invention resides in that the freezing cylinder is placed vertically along the axis thereof, receives water for making ice at a lower part thereof and discharges scrapped ice from an upper part thereof; the evaporator is provided on the outer peripheral surface of the freezing cylinder, ranging from the upper part to the lower part of the freezing cylinder; and the inlet of the evaporator into which refrigerant flows is placed at the upper part of the freezing cylinder.

The above-described feature allows the temperature at the inlet of the evaporator to be assuredly kept at a constant low temperature, so that the ice generated within the freezing cylinder, scraped off and extruded by the ice-scraping auger is tightly compressed, resulting in good-quality ice being extruded.

It is still another feature of the present invention to provide the auger type ice making machine further comprising an ambient temperature sensor for sensing ambient temperature; and refrigerant outlet temperature change controlling means for decreasing the specified refrigerant outlet temperature as the sensed ambient temperature rises. The above introduction means that as ambient temperature increases, the degree of superheat of the refrigerant in the evaporator is decreased, in other words, the area where liquid refrigerant remains in the evaporator is increased, which imparts enhanced ice-making performance to the freezing apparatus. Even when excessively high or low ambient temperature cannot be overcome by the above-described control of refrigerant flow, therefore, the feature of the present invention enables the freezing apparatus to maintain specified performance in making ice, keeping the quality of ice to be generated consistent.

A further feature of the present invention resides in that the ambient temperature sensor and the refrigerant outlet temperature change controlling means may be replaced with a water temperature sensor for sensing temperature of water to be supplied to the freezing cylinder and refrigerant outlet temperature change controlling means for decreasing the specified refrigerant outlet temperature as the sensed water temperature rises. The feature of the present invention decreases the degree of superheat of the refrigerant in the evaporator as the temperature of water to be supplied to the freezing cylinder increases, imparting enhanced ice-making performance to the freezing apparatus. Even when excessively high or low temperature of water supplied to the freezing cylinder cannot be overcome by the above-described control of refrigerant flow, therefore, the freezing apparatus can maintain specified ice-making performance, keeping the quality of ice to be generated consistent.

A still further feature of the present invention resides in that the ambient temperature sensor and refrigerant outlet temperature change controlling means may be replaced with a current sensor for sensing current flowing into the auger motor; and refrigerant outlet temperature change controlling means for increasing the specified refrigerant outlet temperature as the sensed current increases. Another feature of the present invention resides in that the ambient temperature sensor and the refrigerant outlet temperature change controlling means may be replaced with a torque sensor for sensing torque transmitted from the auger motor to the ice-scraping auger; and refrigerant outlet temperature change controlling means for increasing the specified refrigerant outlet temperature as the sensed torque increases. A further feature of the present invention resides in that the ambient temperature sensor and the refrigerant outlet temperature change controlling means may be replaced with a distortion sensor for sensing distorted amount of the freezing cylinder; and refrigerant outlet temperature change controlling means for increasing the specified refrigerant outlet temperature as the sensed distorted amount increases.

The current flowing into the auger motor, the torque transmitted from the auger motor to the ice-scraping auger, and the distorted amount of the freezing cylinder increase when an excessive amount of ice is generated due to an excessively low ambient temperature or excessively low temperature of water supplied to the freezing cylinder, for example. In these cases, therefore, contrarily to the above, the degree of superheat of refrigerant in the evaporator increases, resulting in the ice-making performance of the freezing apparatus being degraded. Even when excessive generation of ice cannot be overcome by the above-described control of refrigerant flow, therefore, these features can keep the ice-making performance of the freezing apparatus within specified performance, maintaining consistent quality of ice to be generated. Furthermore, the above-described features can avoid a heavy load applied to the auger motor which drives the ice-scraping auger and a significant thrust exerted on the blade of the ice-scraping auger, resolving the problem of ice clogging caused by increased resistance applied to the spiral blade of the ice-scraping auger at the passage of ice to make such ice making machine failure-resistant.

A still further feature of the present invention is to provide the auger type ice making machine further comprising a performance inputting device for inputting performance of the freezing apparatus; and refrigerant outlet temperature setting controlling means for setting the specified refrigerant outlet temperature in accordance with the input performance. In this case, input with the performance inputting device may be the level of the ice-making performance, the refrigerant outlet temperature, etc. The feature enables the user to arbitrarily designate, with ease, the degree of superheat of refrigerant in the evaporator. As described above, therefore, the user can vary the area where liquid refrigerant remains in the evaporator, i.e., the area where refrigerant can make ice in the evaporator to extensively vary the ice-making performance of the freezing apparatus, responding, with facility, to changes in demand for ice in accordance with season, circumstances, or the like.

It is another feature of the present invention to provide an auger type ice making machine provided with a freezing cylinder, an ice-scraping auger, an auger motor, a freezing apparatus and a motor which are similar to those described above, the auger type ice making machine comprising a variable control valve being interposed between the condenser and the evaporator; the opening of the variable control valve being electrically controlled and changed; an outlet temperature sensor for sensing refrigerant temperature at an outlet of the evaporator; an outlet pressure sensor for sensing refrigerant pressure at the outlet of the evaporator; saturation temperature calculating means for calculating saturation temperature of refrigerant on the basis of the sensed refrigerant pressure at the outlet of the evaporator; superheat calculating means for subtracting the calculated saturation temperature from the sensed refrigerant temperature at the outlet of the evaporator and thereby obtaining the degree of superheat of refrigerant in the evaporator; and valve opening controlling means for controlling the opening of the variable control valve such that the calculated degree of superheat is kept at a specified degree of superheat.

Through the use of refrigerant temperature and refrigerant pressure at the outlet of the evaporator, the feature controls such that the degree of superheat in the evaporator is kept constant. Therefore, the feature enables the freezing apparatus to maintain specified performance of making ice regardless of changes in ambient temperature or water temperature, resolving problems of liquid back to the compressor and failure-proneness.

A further feature of the present invention resides in that the outlet pressure sensor and the superheat calculating means may be replaced with an inlet temperature sensor for sensing refrigerant temperature at an inlet of the evaporator and superheat calculating means for subtracting the sensed refrigerant temperature at the inlet of the evaporator from the sensed refrigerant temperature at the outlet of the evaporator and thereby obtaining the degree of superheat of refrigerant in the evaporator. In this case, since the refrigerant temperature at the inlet of the evaporator is approximately equal to the saturation temperature of the refrigerant, the feature can draw the degree of superheat similar to that derived in the above-described feature. In this feature as well as the above-described feature, the opening of the valve is controlled in accordance with the degree of the superheat. As in the case of the above-described feature, therefore, this feature also enables the freezing apparatus to maintain specified performance in making ice regardless of changes in ambient temperature or water temperature, resolving problems of liquid back to the compressor and failure-proneness.

A still further feature of the present invention is to provide the auger type ice making machine further comprising an ambient temperature sensor for sensing ambient temperature; and superheat change controlling means for decreasing the specified degree of superheat as the sensed ambient temperature rises. Due to this feature, the area in the evaporator where liquid refrigerant remains increases with increase in ambient temperature, which imparts enhanced ice-making performance to the freezing apparatus. Even when a rise or drop in ambient temperature cannot be overcome by the control of refrigerant flow, therefore, this feature enables the freezing apparatus to maintain specified ice-making performance, keeping the quality of ice to be generated consistent.

Another feature of the present invention resides in that the ambient temperature sensor and the superheat change controlling means may be replaced with a water temperature sensor for sensing temperature of water to be supplied to the freezing cylinder and superheat change controlling means for decreasing the specified degree of superheat as the sensed water temperature rises. Due to this feature as well, the area in the evaporator where liquid refrigerant remains increases with increase in water temperature, which imparts enhanced ice-making performance to the freezing apparatus. Even when a rise or drop in water temperature cannot be overcome by the control of refrigerant flow, therefore, this feature enables the freezing apparatus to maintain specified ice-making performance, keeping the quality of ice to be generated consistent.

Still another feature of the present invention resides in that the ambient temperature sensor and the superheat change controlling means may be replaced with a current sensor for sensing current flowing into the auger motor and superheat change controlling means for increasing the specified degree of superheat as the sensed current increases. A further feature of the present invention resides in that the ambient temperature sensor and the superheat change controlling means may be replaced with a torque sensor for sensing torque transmitted from the auger motor to the ice-scraping auger and superheat change controlling means for increasing the specified degree of superheat as the sensed torque increases. A still further feature of the present invention resides in that the ambient temperature sensor and the superheat change controlling means may be replaced with a distortion sensor for sensing distorted amount of the freezing cylinder and superheat change controlling means for increasing the specified degree of superheat as the sensed distorted amount increases.

The current flowing into the auger motor, the torque transmitted from the auger motor to the ice-scraping auger, and the distorted amount of the freezing cylinder increase, as described above, when an excessive amount of ice is generated due to an excessively low ambient temperature or excessively low temperature of water supplied to the freezing cylinder, for example. In these cases, therefore, contrarily to the above, the degree of superheat of refrigerant in the evaporator increases, resulting in the ice-making performance of the freezing apparatus being degraded. Even when excessive generation of ice cannot be overcome by the above-described control of refrigerant flow, therefore, these features can keep the ice-making performance of the freezing apparatus within specified performance, maintaining consistent quality of ice to be generated. Furthermore, the above-described features can avoid a heavy load applied to the auger motor which drives the ice-scraping auger and a significant thrust exerted on the blade of the ice-scraping auger, resolving the problem of ice clogging caused by increased resistance applied to the spiral blade of the ice-scraping auger at the passage of ice to make such ice making machine failure-resistant.

Another feature of the present invention is to provide the auger type ice making machine further comprising a performance inputting device for inputting performance of the freezing apparatus and superheat setting controlling means for setting the specified degree of superheat in accordance with the input performance. In this case as well, input with the performance inputting device may be the level of the ice-making, the degree of superheat, etc. The feature enables the user to arbitrarily designate, with ease, the degree of superheat of refrigerant in the evaporator. As described above, therefore, the user can vary the area where liquid refrigerant remains in the evaporator, i.e., the area where refrigerant can make ice in the evaporator to extensively vary the ice-making performance of the freezing apparatus, responding, with facility, to changes in demand for ice in accordance with season, circumstances, or the like.

BEST MODE FOR CARRYING OUT THE INVENTION a. First Embodiment

Figure 1:
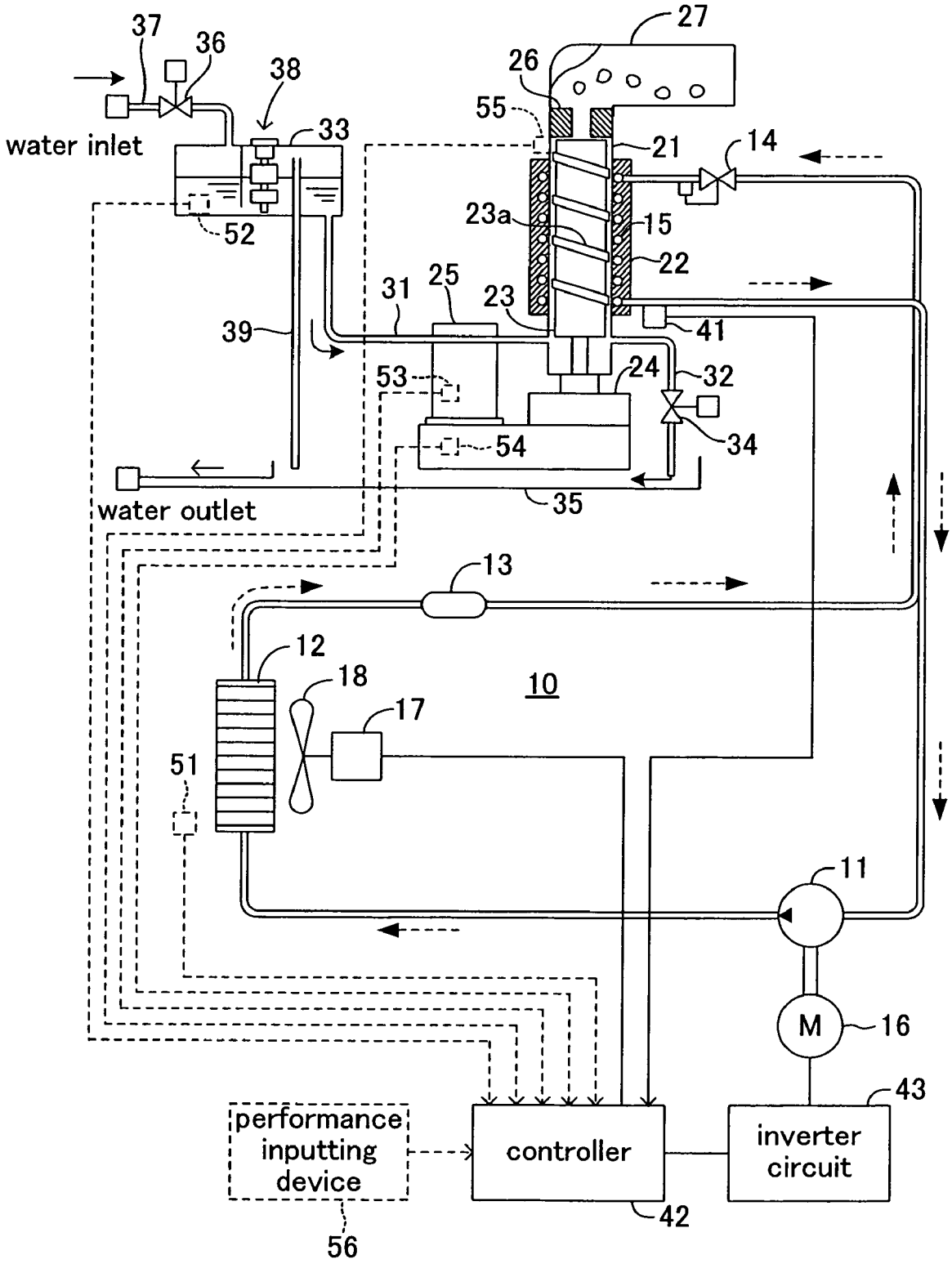
FIG. 1 is a schematic diagram showing the general arrangement of an auger type ice making machine according to a first embodiment of the present invention.

A first embodiment of the present invention will now be described with reference to the drawings. FIG. 1 schematically shows the general arrangement of an auger type ice making machine according to the first embodiment. This auger type ice making machine is provided with a freezing apparatus 10 composed of a compressor 11, a condenser 12, a dryer 13, a constant pressure expansion valve 14 and an evaporator 15 which are interconnected by way of pipes in this order to circulate refrigerant in the direction as indicated by broken-line arrows.

The compressor 11 is rotatably driven by a motor 16 to discharge high-temperature and high-pressure refrigerant gas. The motor 16, which is speed-controllable, can employ a permanent magnet synchronous motor, for example. The condenser 12 causes the high-temperature and high-pressure refrigerant gas discharged from the compressor 11 to lose heat to liquefy. The liquefied refrigerant is then supplied to the constant pressure expansion valve 14 through the dryer 13. The condenser 12 is forcibly cooled by a cooling fan 18 driven by a fan motor 17. The dryer 13 dehydrates the refrigerant. The constant pressure expansion valve 14 automatically maintains the pressure of the refrigerant to be supplied to the evaporator 15 at a specified low pressure in response to the refrigerant pressure on the downstream side thereof. More specifically, when the refrigerant pressure on the downstream side thereof decreases, the constant pressure expansion valve 14 is opened more to increase the refrigerant pressure on the downstream side thereof. When the refrigerant pressure on the downstream side increases, the constant pressure expansion valve 14 is closed more to decrease the refrigerant pressure on the downstream side thereof. Assuming that R134a refrigerant is used, for instance, the above-described specified low pressure is set approximately at 0.07 megapascal gauge pressure. The evaporator 15 is wound closely around the outer peripheral surface of a freezing cylinder 21 to range from the upper part to the lower part of the cylinder 21, evaporating the supplied refrigerant to cool the freezing cylinder 21. Around the evaporator 15 there is provided a heat insulator 22.

The freezing cylinder 21, which is cylindrically shaped and placed vertically along the axis thereof, houses an ice-scraping auger 23, allowing the ice-scraping auger 23 to rotate about the axis. The ice-scraping auger 23 whose lower end is connected to a reduction gear 24 is driven rotatively by driving torque transmitted through the reduction gear 24 from an auger motor 25 composed by an AC motor. On the outer peripheral surface of the ice-scraping auger 23 there is provided a spiral blade 23*a* for scraping off ice formed on the inner surface of the freezing cylinder 21. At the upper part of the freezing cylinder 21 there is mounted a press head portion 26 for narrowing an internal passage. The press head portion 26 compresses and dehydrates ice that has been scraped off by the spiral blade 23*a* of the ice-scraping auger 23, transforming the thus sent ice into ice chips, for example, to deliver them to a discharge cylinder 27 that is connected to an ice reservoir which is not shown.

To the lower part of the freezing cylinder 21 there are connected the outlet of a feed water pipe 31 and the inlet of a water drain pipe 32. The inlet of the feed water pipe 31 is connected to the undersurface of a water reservoir 33. The water drain pipe 32, which interposes a water drain valve 34 composed of an electromagnetic valve, is open toward a drain pan 35. The water drain valve 34 closes its passage in the non-energized state, while opening it in the energized state.

To the water reservoir 33 there is selectively supplied running water from a water pipe 37 which interposes a feed water valve 36 composed of an electromagnetic valve. The feed water valve 36 closes its passage in the non-energized state, while opening it in the energized state. The water reservoir 33 houses a float switch device 38 having an upper float switch and a lower float switch that respectively sense that stored water has reached an upper limit and lower limit. The water reservoir 33 also has an overflow pipe 39 that is open toward the drain pan 35 in order to prevent water from overflowing from the water reservoir 33.

Next explained will be an electric circuit apparatus of the auger type ice making machine configured as described above. The electric circuit apparatus includes a temperature sensor 41, a controller 42 and an inverter circuit 43. The temperature sensor 41 is located on a downstream pipe of the evaporator 15 to sense a downstream refrigerant temperature (i.e., refrigerant temperature at the outlet of the evaporator 15) Te and output the sensed temperature to the controller 42. The controller 42 whose major component is a microcomputer composed of a CPU, ROM, RAM, etc. controls the rotational speed of the motor 16 through the inverter circuit 43, thereby performing feedback control so that the refrigerant temperature Te at the outlet of the evaporator 15 is kept at a specified refrigerant temperature Teo (e.g., approximately −13° C.). The inverter circuit 43, which is controlled by the controller 42, controls the power supplied to the motor 16 to eventually control the rotational speed of the motor 16.

The specified refrigerant temperature Teo is a predetermined value which is automatically determined by specifying the downstream pressure of the constant pressure expansion valve 14 and the degree of superheat of the refrigerant in the evaporator 15. More specifically, the downstream refrigerant temperature of the constant pressure expansion valve 14, i.e., the refrigerant temperature at the inlet of the evaporator 15 (−15° C. in this embodiment) is uniquely defined by the downstream refrigerant pressure of the constant pressure expansion valve 14, i.e., the refrigerant pressure at the inlet of the evaporator 15. The refrigerant temperature at the inlet of the evaporator 15 is almost equal to the evaporative temperature of the refrigerant in the evaporator 15. If the degree of superheat is set to 2° C., therefore, the specified refrigerant temperature Teo is approximately −13° C. in this embodiment. For this type of ice making machine, appropriate degree of superheat is considered to be 2 to 3° C.

Also connected to the controller 42 is a fan motor 17 whose actuation is also controlled by the controller 42. To the controller 42, in addition, there are connected the auger motor 25, water drain valve 34, feed water valve 36 and float switch device 38 whose connections are not shown.

Next explained will be the operation of the first embodiment configured as described above. When the ice making machine of the first embodiment is actuated, the controller 42 controls, in response to the water level sensed by the float switch device 38, the energization and non-energization of the feed water valve 36 to constantly maintain the water level of the water reservoir 33 at specified levels. As a result, the water level in the freezing cylinder 21 communicating the water reservoir 33 is also constantly maintained at specified levels. In a case where water in the freezing cylinder 21 needs to be drained, the water drain valve 34 is energized to be opened, resulting in water in freezing cylinder 21 drained out.

The controller 42 actuates the auger motor 25, fan motor 17 and motor 16. The rotational torque of the auger motor 25 is transmitted to the ice-scraping auger 23 through the reduction gear 24, so that the ice-scraping auger 23 starts rotating about the axis. The fan motor 17 rotates the cooling fan 18 to start cooling the condenser 12. The motor 16 actuates the compressor 11 to start discharging refrigerant from the compressor 11. The high-temperature and high-pressure refrigerant discharged from the compressor 11 then starts circulating within the freezing apparatus 10 including the condenser 12, dryer 13, constant pressure expansion valve 14 and evaporator 15 in the direction as indicated by broken-line arrows in FIG. 1.

Due to the circulation of refrigerant, the evaporator 15 cools the freezing cylinder 21. In this state, water for making ice is supplied to the freezing cylinder 21 from the water reservoir 33 through the feed water pipe 31, so that ice is formed on the inner peripheral surface of the cylinder 21. The thus-formed ice is scraped off by the spiral blade 23*a* rotated along with the rotating ice-scraping auger 23 and then sent upward to transform by the action of the press head portion 26 into ice chips or the like. The ice chips are then discharged into the discharge cylinder 27.

On this refrigerant circulation, the controller 42 controls the rotational speed of the motor 16 so that the refrigerant temperature Te at the outlet of the evaporator 15 is kept at the specified refrigerant temperature Teo. At high ambient temperature or high water temperature, more specifically, since the freezing apparatus (particularly, the compressor 11) decreases in performance, and a significant heat load is applied to the freezing cylinder 21, the constant pressure expansion valve 14 squeezes the valve so that the refrigerant pressure (refrigerant temperature) at the inlet of the evaporator 15 is kept constant. As a result, the amount of refrigerant flowing into the evaporator 15 is reduced. More specifically, the area in the evaporator 15 where liquid refrigerant remains, i.e., the area where the refrigerant can make ice in the evaporator 15 is reduced, so that the degree of superheat of the refrigerant grows to increase the refrigerant temperature at the outlet of the evaporator 15. On this occasion, since the controller 42 controls the rotational speed of the motor 16 so that the refrigerant temperature at the outlet of the evaporator 15 is kept at the specified refrigerant outlet temperature, in other words, the controller 42 controls to increase the rotational speed of the motor 16, the amount of refrigerant in the evaporator 15 to be sucked into the compressor 11 increases in spite of the refrigerant pressure and refrigerant temperature at the inlet of the evaporator 15 being kept constant, so that the amount of refrigerant flowing into the evaporator 15 through the condenser 12 and dryer 13 increases. As a result, the area where refrigerant can make ice in the evaporator 15 increases, so that this freezing apparatus can keep specified performance in making ice even in high ambient temperature or high water temperature.

At low ambient temperature or low water temperature, on the other hand, since the freezing apparatus (particularly, the compressor 11) increases in performance, and a heat load applied to the freezing cylinder 21 is light, the constant pressure expansion valve 14 is opened so that the refrigerant pressure (refrigerant temperature) at the inlet of the evaporator is kept constant. As a result, the amount of refrigerant flowing into the evaporator 15 increases to increase the area in the evaporator 15 where liquid refrigerant remains, i.e., the area where the refrigerant can make ice in the evaporator 15, so that the degree of superheat of the refrigerant is reduced to decrease the refrigerant temperature at the outlet of the evaporator 15. On this occasion, since the controller 42 controls the rotational speed of the motor 11 so that the refrigerant temperature at the outlet of the evaporator 15 is kept at the specified refrigerant outlet temperature, in other words, since the controller 42 controls to decrease the rotational speed of the motor 11, the amount of refrigerant in the evaporator 15 to be sucked into the compressor 11 decreases in spite of the refrigerant pressure and refrigerant temperature at the inlet of the evaporator 15 being kept constant, so that the amount of refrigerant flowing into the evaporator 15 through the condenser 12 and dryer 13 decreases. As a result, the area where refrigerant can make ice in the evaporator 15 decreases, so that this freezing apparatus can keep specified performance in making ice even in low ambient temperature or low water temperature.

As apparent from the above operational description, in spite of the simple configuration that performs feedback control of the rotation of the motor 16 in response to the refrigerant temperature Te at the outlet of the evaporator 15, the above-described first embodiment enables the freezing apparatus 10 to maintain specified performance in making ice regardless of changes in ambient temperatures or water temperatures, resolving problems of liquid back to the compressor 11 and failure-proneness. As described above, in addition, the refrigerant temperature at the inlet of the evaporator 15 is approximately equal to the evaporative temperature of the refrigerant in the evaporator 15. Since the constant pressure expansion valve 14 keeps the refrigerant pressure (i.e., refrigerant temperature) at the inlet of the evaporator 15 constant, the evaporative temperature of the refrigerant in the evaporator 15 is kept almost constant, resulting in the quality of ice to be generated being kept consistent.

Due to the layout of the above-described embodiment in which the inlet of the evaporator 15 into which refrigerant flows is placed at the upper part of the freezing cylinder, moreover, the temperature at the inlet of the evaporator 15 is assuredly kept at a constant low temperature, so that the ice generated within the freezing cylinder 21, scraped off and extruded by the ice-scraping auger 23 is tightly compressed, resulting in good-quality ice being extruded.

In the first embodiment, moreover, on condition that R134a refrigerant is used, the refrigerant pressure at the inlet of the evaporator 15 is kept at 0.07 megapascal gauge pressure (equivalent to the refrigerant temperature of −15° C.), while the specified refrigerant temperature Teo at the outlet of the evaporator 15 is set to −13° C. However, it is evident from various experiments that favorable results can be also obtained when the refrigerant pressure at the inlet of the evaporator 15 is kept at a specified value falling within the range of approximately 0.01 to 0.10 megapascal gauge pressure (equivalent to the refrigerant temperature of −25 to −10° C.) while the specified refrigerant temperature Teo at the outlet of the evaporator 15 is kept at a specified value falling within the range of −23 to −8° C.

Figure 2A:
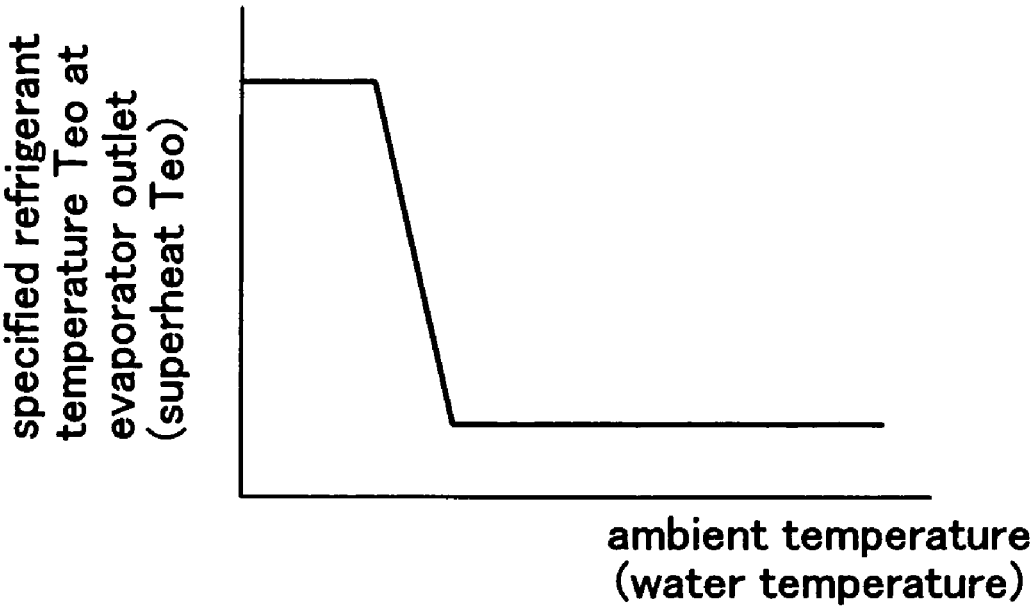
FIG. 2A is a diagram showing the relationship between ambient temperature (or water temperature) and specified refrigerant temperature at an evaporator outlet (or degree of superheat)

In addition, the first embodiment may have an ambient temperature sensor 51 for sensing ambient temperature of the auger ice making machine in the vicinity of the condenser 12 as shown in broken lines in FIG. 1 to allow the controller to perform control such that the specified refrigerant temperature Teo at the outlet of the evaporator 15 is decreased with increase in the sensed ambient temperature as shown in FIG. 2(A). Such control means that as ambient temperature increases, the degree of superheat of refrigerant in the evaporator 15 is decreased, in other words, the area in the evaporator 15 where liquid refrigerant remains is increased, which imparts enhanced ice-making performance to the freezing apparatus 10. Even when excessively high or low ambient temperature cannot be overcome by the control of refrigerant flow performed in the first embodiment, therefore, the modified example enables the freezing apparatus 10 to maintain specified performance in making ice, keeping the quality of ice to be generated consistent.

Moreover, the first embodiment may provide the water reservoir 33 with a water temperature sensor 52 for sensing the temperature of water to be supplied to the freezing cylinder 21 as shown in broken lines in FIG. 1 to allow the controller to perform control such that the specified refrigerant temperature Teo at the outlet of the evaporator 15 is decreased with increase in the sensed water temperature as shown in FIG. 2(A). Such control also decreases the degree of superheat of the refrigerant in the evaporator 15 with increase in temperature of the water to be supplied to the freezing cylinder 21, imparting enhanced ice-making performance to the freezing apparatus 10. Even when excessively high or low temperature of water to be supplied to the freezing cylinder 21 cannot be overcome by the control of refrigerant flow performed in the first embodiment, therefore, the modified example enables the freezing apparatus 10 to maintain specified performance in making ice, keeping the quality of ice to be generated consistent.

Figure 2B:
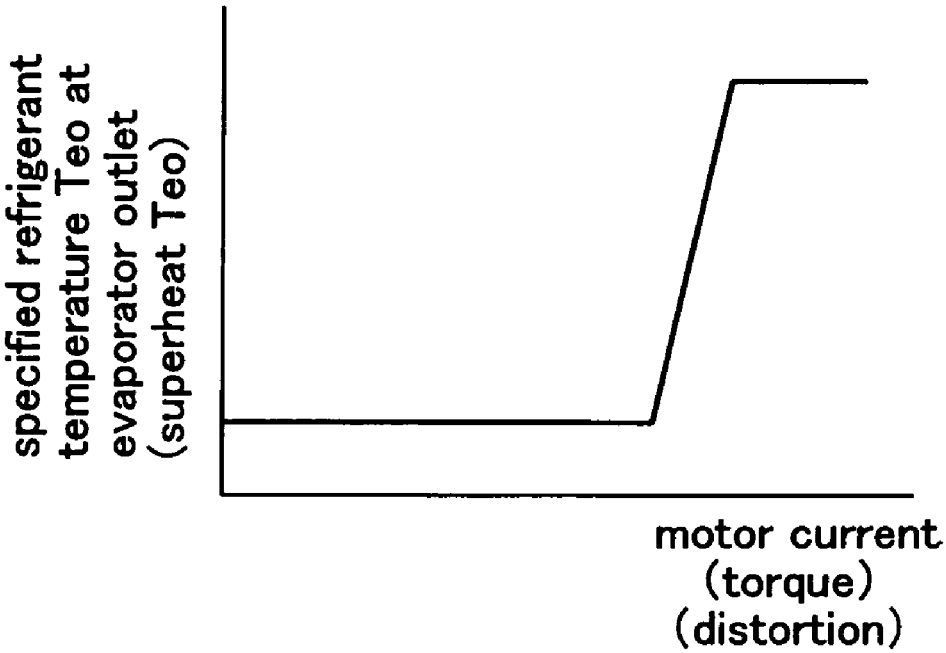
FIG. 2B is a diagram showing the relationship between motor current (or torque or amount of distortion) and specified refrigerant temperature at the evaporator outlet (or degree of superheat)

In addition, the first embodiment may have a current sensor 53 for sensing the current flowing into the auger motor 25 as shown in broken lines in FIG. 1 to allow the controller to perform control such that the specified refrigerant temperature Teo at the outlet of the evaporator 15 is increased with increase in the sensed motor current as shown in FIG. 2(B). The current flowing into the auger motor 25 increases when an excessive amount of ice is generated due to an excessively low ambient temperature or excessively low temperature of water supplied to the freezing cylinder 21, for example. In this case, therefore, contrarily to the above examples, the degree of superheat of refrigerant in the evaporator 15 increases when an excessive amount of ice is generated, degrading ice-making performance of the freezing apparatus 10. Even when excessive generation of ice cannot be overcome by the control of refrigerant flow, therefore, this modification can keep the ice-making performance of the freezing apparatus 10 within specified performance, maintaining consistent quality of ice to be generated.

In addition, the first embodiment may have a torque sensor 54 which is located on any one of the mechanical parts from the auger motor 25 to the ice-scraping auger 23 as shown in broken lines in FIG. 1 to sense the torque transmitted from the auger motor 25 to the ice-scraping auger 23 to allow the controller to control such that the specified refrigerant temperature Teo at the outlet of the evaporator 15 is increased with increase in the sensed torque as shown in FIG. 2(B). Furthermore, the first embodiment may have a distortion sensor 55 for sensing a distorted amount of the freezing cylinder to allow the controller to perform control such that the specified refrigerant temperature Teo at the outlet of the evaporator 15 is increased with increase in the sensed distortion as shown in FIG. 2(B). In these cases as well as the case of the current flowing into the auger motor 25, when an excessive amount of ice is generated due to an excessively low ambient temperature or excessively low temperature of water to be supplied to the freezing cylinder 21, for example, the torque sensed by the torque sensor 54 and distorted amount sensed by the distortion sensor 55 increase.

In these cases as well, therefore, the degree of superheat of refrigerant in the evaporator 15 increases when an excessive amount of ice is generated, degrading ice-making performance of the freezing apparatus 10. Even when excessive generation of ice cannot be overcome by the control of refrigerant flow, therefore, these modification can keep the ice-making performance of the freezing apparatus 10 within specified performance, maintaining consistent quality of ice to be generated. Furthermore, the above-described examples can avoid a heavy load applied to the auger motor 25 which drives the ice-scraping auger 23 and a significant thrust exerted on the blade of the ice-scraping auger 23, resolving the problem of ice clogging caused by increased resistance applied to the spiral blade 23*a* of the ice-scraping auger 23 at the passage of ice to make such ice making machine failure-resistant.

In addition, the first embodiment may have a performance inputting device 56 for inputting the performance of the freezing apparatus 10 as shown in broken lines in FIG. 1 to allow the controller 42 to set the specified refrigerant temperature Teo at the outlet of the evaporator 15 in response to the input performance of the freezing apparatus 10. In this case, the performance inputting device 56, which is composed of setting switches, volumes, select switches, etc. operated by a user, is designed such that the user can designate the performance of the freezing apparatus 10 seamlessly or step-by-step from low performance to high performance. The performance may be input as data or signal indicative of the level of performance, or numerical data or numerical signal indicative of the specified refrigerant temperature Teo. The modified example having the performance inputting device 56 eventually enables the user to arbitrarily designate the degree of superheat of refrigerant in the evaporator 15. As described above, therefore, the user can vary the area where refrigerant can make ice in the evaporator 15 to extensively vary the ice-making performance of the freezing apparatus, responding, with facility, to changes in demand for ice in accordance with season, circumstances, or the like.

b. Second Embodiment

Figure 3:
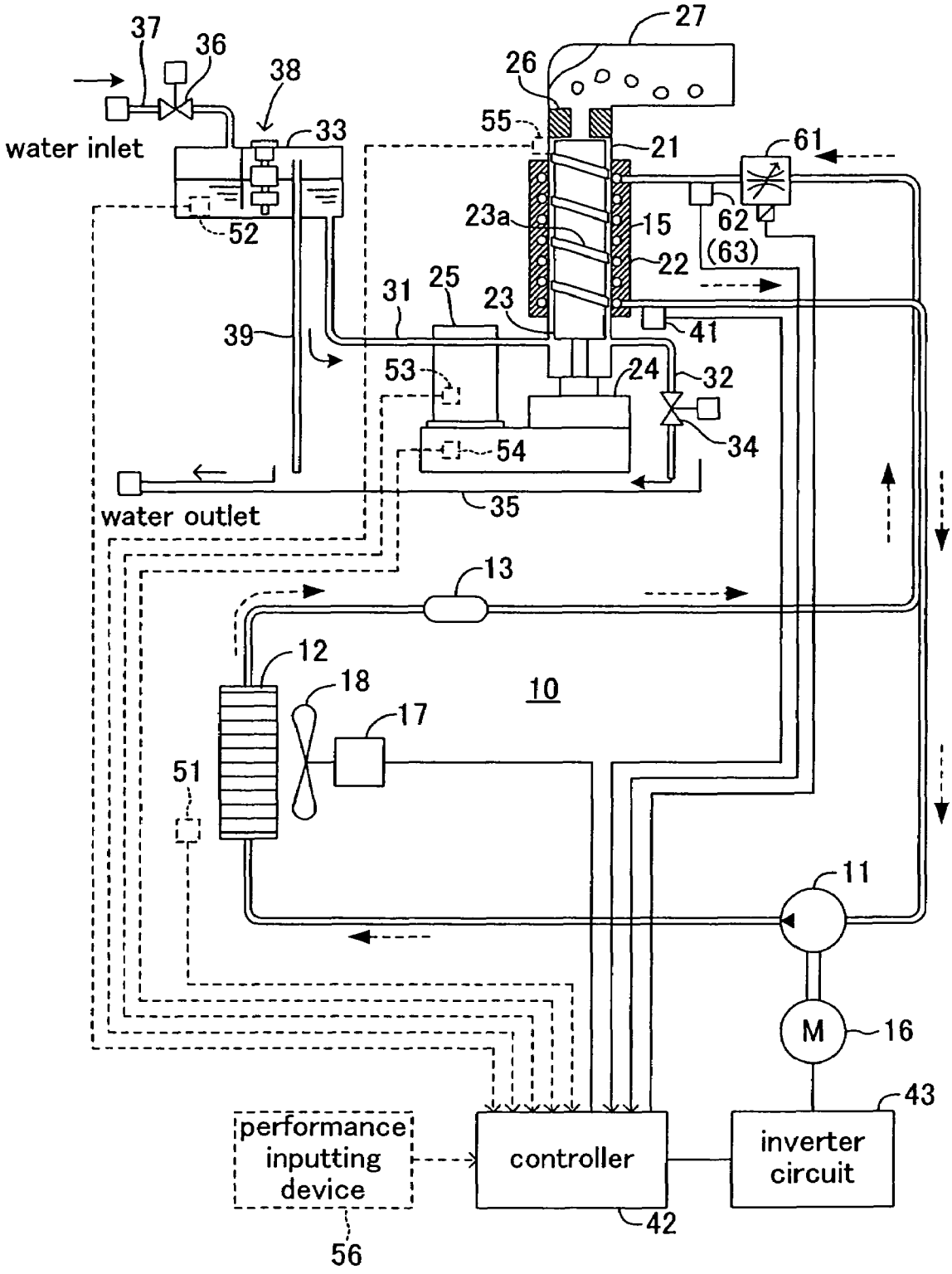
FIG. 3 is a schematic diagram showing the general arrangement of an auger type ice making machine according to a second embodiment of the present invention.

Next explained will be an auger type ice making machine according to a second embodiment of the present invention. In the second embodiment, as shown in FIG. 3, the constant pressure expansion valve 14 in the first embodiment is replaced with an electromagnetic valve (motorized expansion valve) 61 provided in between the dryer 13 and evaporator 15. The opening of the electromagnetic valve 61, which is used as a variable control valve, is electrically controlled and changed. In addition, the second embodiment is provided with a pressure sensor 62 for sensing refrigerant pressure on the downstream side of the electromagnetic valve 61. Furthermore, the controller 42 inputs a refrigerant pressure Pv at the inlet of the evaporator 15 sensed by the pressure sensor 62 as well as a refrigerant temperature Te at the outlet of the evaporator 15, and executes a program shown in FIG. 4 to control the motor 16 and the electromagnetic valve 61. Since other points are configured as in the case of the first embodiment, the same numerals as the first embodiment are given to the second embodiment to omit descriptions thereof.

Figure 4:
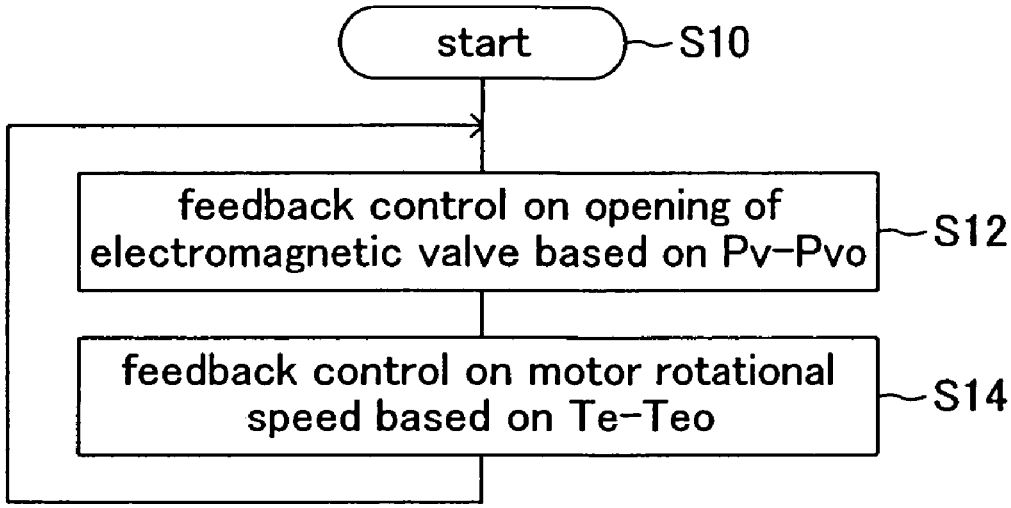
FIG. 4 is a flowchart of a program executed by a controller shown in FIG. 3 according to the second embodiment of the present invention.

In the second embodiment configured as described above, when an instruction to start the auger type ice making machine is given, the controller 42 starts the program shown in FIG. 4 at step S10 and repeatedly executes the processes of steps S12 and S14. Although this program also controls the fan motor 17, auger motor 25, water drain valve 34 and feed water valve 36, description about the control is omitted because it is done as in the case of the first embodiment.

At step S12 the controller 42 inputs a refrigerant pressure Pv at the inlet of the evaporator 15 sensed by the pressure sensor 62 and performs, by use of a pressure difference Pv-Pvo between the input refrigerant pressure Pv and a specified low pressure Pvo (e.g., 0.07 megapascal gauge pressure), feedback control on the opening of the electromagnetic valve 61 such that the refrigerant pressure on the downstream side of the electromagnetic valve 61, i.e., the pressure of refrigerant to be supplied to the evaporator 15 is kept at the specified low pressure Pvo. More specifically, when the sensed refrigerant pressure Pv is lower than the specified low pressure Pvo, the electromagnetic valve 61 is opened more to increase the refrigerant pressure on the downstream side of the electromagnetic valve 61. When the sensed refrigerant pressure Pv is higher than the specified low pressure Pvo, on the other hand, the electromagnetic valve 61 is closed more to decrease the refrigerant pressure on the downstream side of the electromagnetic valve 61. Due to the control on the opening of the electromagnetic valve 61, the refrigerant pressure on the downstream side of the electromagnetic valve 61, i.e., the refrigerant pressure to be supplied to the evaporator 15 is kept at the specified low pressure. As in the case of the first embodiment, as a result, the refrigerant pressure Pv at the inlet of the evaporator 15 is constantly kept at the specified low pressure Pvo. Furthermore, the refrigerant temperature at the inlet of the evaporator 15 is kept at −15° C.

At step S14 the controller 42 inputs a refrigerant temperature Te at the outlet of the evaporator 15 sensed by the temperature sensor 41 and controls, by use of a temperature difference Te-Teo between the input refrigerant temperature Te and a specified refrigerant temperature Teo (e.g., −13° C.) at the outlet of the evaporator 15, the rotational speed of the motor 16 through the inverter circuit 43 such that the refrigerant temperature Te at the outlet of the evaporator 15 is kept at the specified refrigerant temperature Teo. This control is performed as in the case of the first embodiment.

The above-described controls allow the pressure of refrigerant and the temperature of refrigerant (i.e., evaporative temperature of refrigerant in the evaporator 15) supplied to the inlet of the evaporator 15 to be constantly kept at the specified low pressure (e.g., 0.07 megapascal gauge pressure) and at the specified low temperature (e.g., −15° C.), respectively, also constantly keeping the refrigerant temperature Te at the outlet of the evaporator 15 at the specified refrigerant temperature (e.g., −13° C.). Therefore, the second embodiment also achieves the same effect as the first embodiment.

Furthermore, the second embodiment may be modified to replace the above-described pressure sensor 62 with a temperature sensor 63 as indicated by a numeral in parentheses in FIG. 3. The temperature sensor 63, which senses refrigerant temperature on the downstream side of the electromagnetic valve 61, i.e., refrigerant temperature Tv at the inlet of the evaporator 15, is installed on the downstream pipe of the electromagnetic valve 61 or on the inlet edge of the evaporator 15. In addition to the refrigerant temperature Te at the outlet of the evaporator 15 sensed by the temperature sensor 41, the controller 42 also inputs the refrigerant temperature Tv at the inlet of the evaporator 15 sensed by the temperature sensor 63 and executes a program shown in FIG. 5 to control the motor 16 and the electromagnetic valve 61. Since other points are configured as in the case of the second embodiment, the same numerals as the second embodiment are given to the above modification to omit descriptions thereof.

Figure 5:
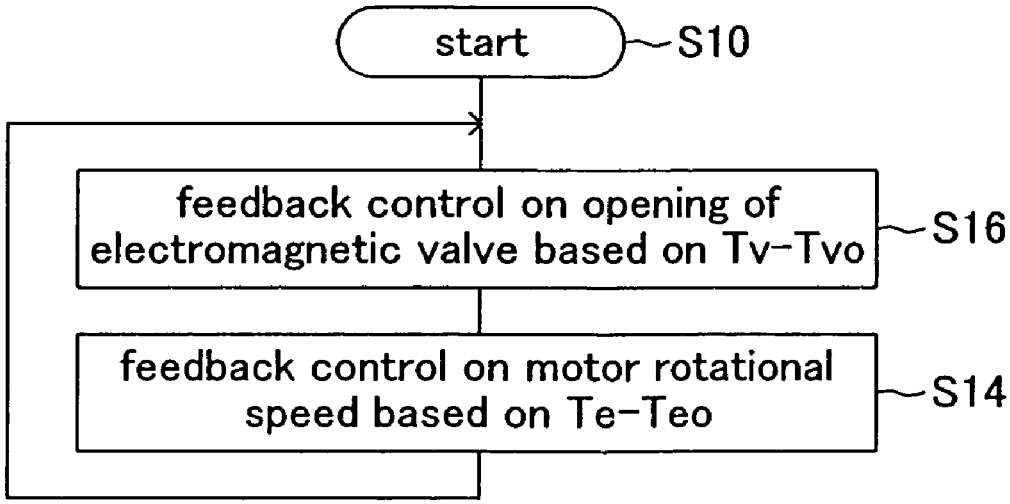
FIG. 5 is a flowchart of a program executed by the controller shown in FIG. 3 according to a modified example of the second embodiment of the present invention.

In this modification, the controller 42 starts the program shown in FIG. 5 at step S10 and repeatedly executes the processes of steps S16 and S14. At step S16 the controller 42 inputs the refrigerant temperature Tv at the inlet of the evaporator 15 sensed by the temperature sensor 63 and performs, by use of a temperature difference Tv−Tvo between the input refrigerant temperature Tv and the specified low temperature Tvo (e.g., −15° C.), feedback control on the opening of the electromagnetic valve 61 such that the refrigerant temperature on the downstream side of the electromagnetic valve 61, i.e., the temperature of refrigerant to be supplied to the evaporator 15 is kept at the specified low temperature (e.g., −15° C.). As in the case of the second embodiment, the above-described control allows the refrigerant temperature at the inlet of the evaporator 15 to be kept at −15° C. Therefore, this modification also achieves the same effect as the first embodiment and second embodiment.

In the second embodiment and its modified example as well, the refrigerant pressure at the inlet of the evaporator 15 may be kept at a specified value falling within the range of approximately 0.01 to 0.10 megapascal gauge pressure (equivalent to the refrigerant temperature of −25 to −10° C.) while the specified refrigerant temperature Teo at the outlet of the evaporator 15 may be kept at a specified value falling within the range of −23 to −8° C.

In the second embodiment and its modified example, furthermore, if the specified low pressure Pvo and low temperature Tvo are set to high values, both the evaporative temperature of the refrigerant in the evaporator 15 and the refrigerant pressure on the downstream side of the electromagnetic valve 61 increase, making the ice making machine energy-efficient. If the specified low pressure Pvo and low temperature Tvo are set to low values, on the other hand, both the evaporative temperature of the refrigerant in the evaporator 15 and the refrigerant pressure on the downstream side of the electromagnetic valve 61 decrease to tightly compress the ice, resulting in good quality ice to be generated. In this case, the good quality ice indicates cold ice having a high percentage of ice content and being excessively cooled.

In the above-described second embodiment and its modified example, furthermore, as shown in broken lines in FIG. 3, as in the cases of the modified examples of the first embodiment, in addition to the configuration of the second embodiment, the ambient temperature sensor 51, water temperature sensor 52, current sensor 53, torque sensor 54, distortion sensor 55 or performance inputting device 56 may be provided. Such modification may be done such that the controller 42 sets the specified refrigerant temperature Teo at the outlet of the evaporator 15 in accordance with the value sensed by the above-described sensors or the performance input by the performance inputting device 56 as in the case of the first embodiment.

c. Third Embodiment

Figure 6:
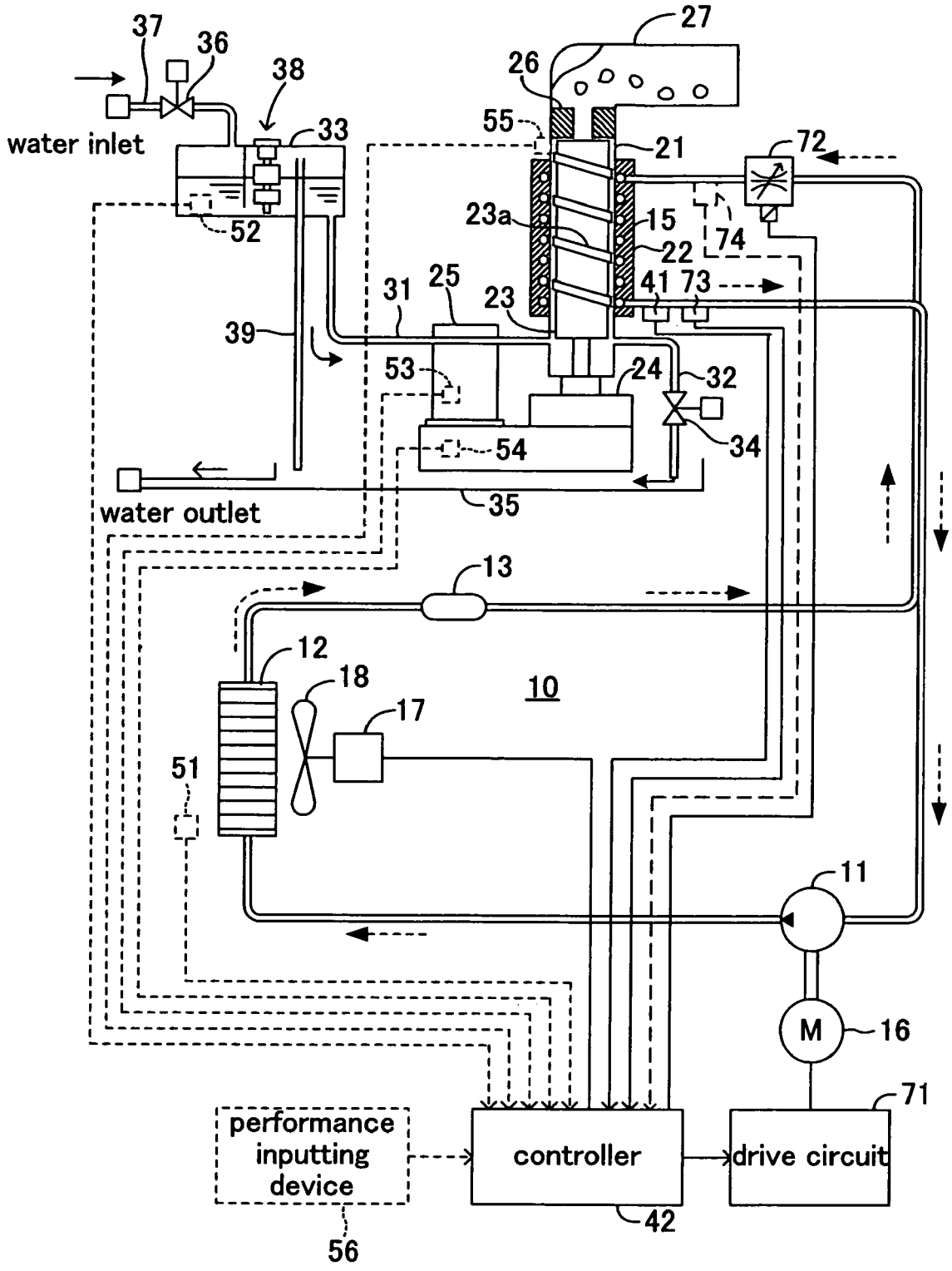
FIG. 6 is a schematic diagram showing the general arrangement of an auger type ice making machine according to a third embodiment of the present invention.

Next explained will be an auger type ice making machine according to a third embodiment of the present invention. In the third embodiment, as shown in FIG. 6, the inverter circuit 43 of the first embodiment is replaced with a drive circuit 71 to connect to the controller 42. The drive circuit 71 controls the motor 16 such that it rotates at a constant speed. In the third embodiment, furthermore, the constant pressure expansion valve 14 in the first embodiment is replaced with an electromagnetic valve (motorized expansion valve) 72 provided in between the dryer 13 and evaporator 15. The opening of the electromagnetic valve 72, which is used as a variable control valve, is electrically controlled and changed. The electromagnetic valve 72 is controlled by the controller 42.

In the third embodiment, furthermore, at the outlet of the evaporator 15 there is provided, in addition to the temperature sensor 41 for sensing a refrigerant temperature Te, a pressure sensor 72 for sensing a refrigerant pressure Pe at the outlet of the evaporator 15. The temperature sensor 41 and the pressure sensor 72 are connected to the controller 42. The controller 42 also inputs a refrigerant pressure Pe at the outlet of the evaporator 15 sensed by the pressure sensor 73 as well as a refrigerant temperature Te at the outlet of the evaporator 15 sensed by the temperature sensor 41. By execution of a program shown in FIG. 7, the controller 42 then controls the electromagnetic valve 72. Since other points are configured as in the case of the first embodiment, the same numerals as the first embodiment are given to the third embodiment to omit descriptions thereof.

In the third embodiment configured as described above, when an instruction to start the auger type ice making machine is given, the controller 42 controls the drive circuit 71 such that the motor 16 rotates at a constant rotational speed. As a result, the compressor 11 discharges a certain amount of high-temperature and high-pressure refrigerant. In addition, the controller 42 starts the program shown in FIG. 7 at step S20 and repeatedly executes the processes of steps S22 to S24. Although this program also controls the fan motor 17, auger motor 25, water drain valve 34 and feed water valve 36 as well, description about the control is omitted because it is done as in the case of the first embodiment.

Figure 8:
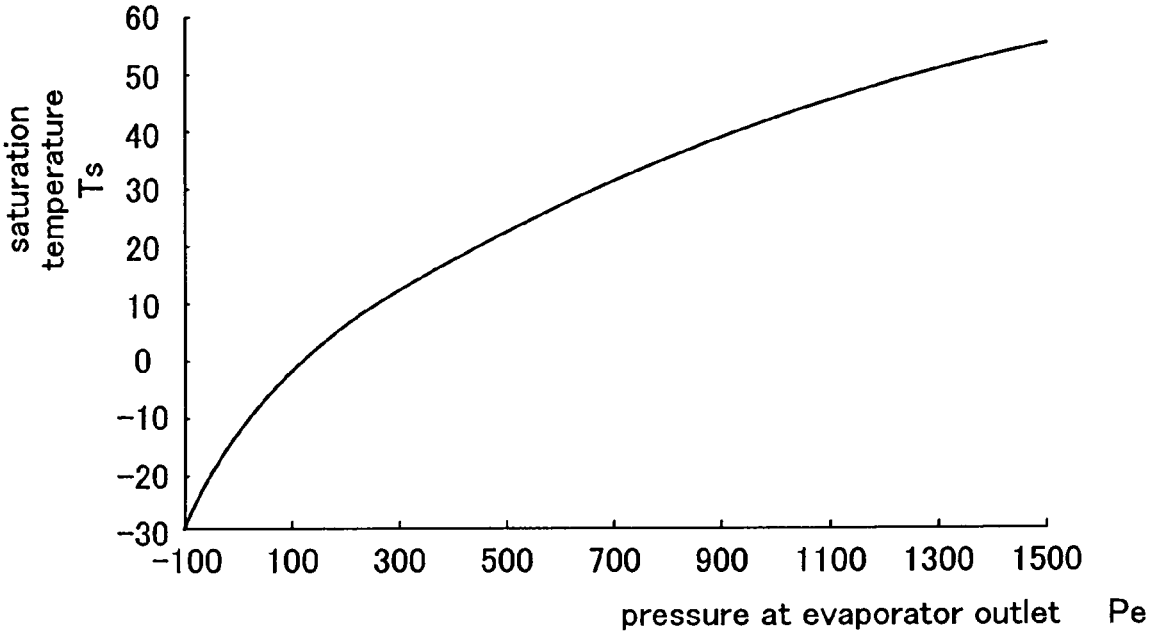
FIG. 8 is a diagram showing the relationship between the pressure and saturation temperature of refrigerant.

At step S22 the controller 42 inputs a refrigerant pressure Pe at the outlet of the evaporator 15 sensed by the pressure sensor 73 to calculate a saturation temperature Ts of refrigerant in the evaporator 15 on the basis of the refrigerant pressure Pe. Used for the calculation of the saturation temperature Ts is a table representative of the relationship between the refrigerant pressure (refrigerant pressure Pe at the outlet of the evaporator 15) and the saturation temperature Ts (see FIG. 8). The relationship between the refrigerant pressure Pe and the saturation temperature Ts is defined according to the type of refrigerant This table is previously stored in the controller 42.

At step S24 the controller 42 inputs a refrigerant temperature Te at the outlet of the evaporator 15 sensed by the temperature sensor 41. The controller 42 then subtracts the above-obtained saturation temperature Ts from the refrigerant temperature Te to obtain the degree of superheat Tx (=Te−Ts) of the refrigerant in the evaporator 15.

At step S26, through the use of a difference Tx−Txo between the above-obtained degree of superheat Tx and a specified degree of superheat Txo, the controller 42 controls the opening of the electromagnetic valve 72 such that the degree of superheat Tx is equal to the specified degree of superheat Txo. If the difference Tx−Txo increases, more specifically, the electromagnetic valve 72 is opened more. Due to the control of the electromagnetic valve 72, the amount of refrigerant supplied to the evaporator 15 increases to decrease the degree of superheat Tx. If the difference Tx−Txo decreases, on the other hand, the electromagnetic valve 72 is closed more. Due to the control of the electromagnetic valve 72, the amount of refrigerant supplied to the evaporator 15 decreases to increase the degree of superheat Tx. As a result, the degree of superheat Tx of refrigerant in the evaporator 15 is constantly kept at the specified degree of superheat Txo.

As described above, through the use of refrigerant temperature Te and refrigerant pressure Pe at the outlet of the evaporator 15, the third embodiment is controlled such that the degree of superheat Tx in the evaporator 15 is kept constant. Therefore, as in the case of the first embodiment, the third embodiment enables the freezing apparatus 10 to maintain specified performance in making ice regardless of changes in ambient temperatures or water temperatures, resolving problems of liquid back to the compressor 11 and failure-proneness.

Due to the layout of the third embodiment in which the inlet of the evaporator 15 into which refrigerant flows is placed at the upper part of the freezing cylinder, moreover, the temperature at the inlet of the evaporator 15 is assuredly kept at a constant low temperature, so that the ice generated within the freezing cylinder 21, scraped off and extruded by the ice-scraping auger 23 is tightly compressed, resulting in good-quality ice being extruded.

Figure 7:
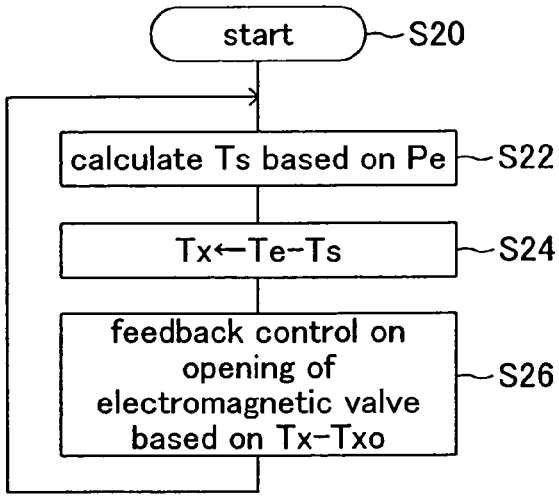
FIG. 7 is a flowchart of a program executed by a controller shown in FIG. 6 according to the third embodiment of the present invention.
Figure 9:
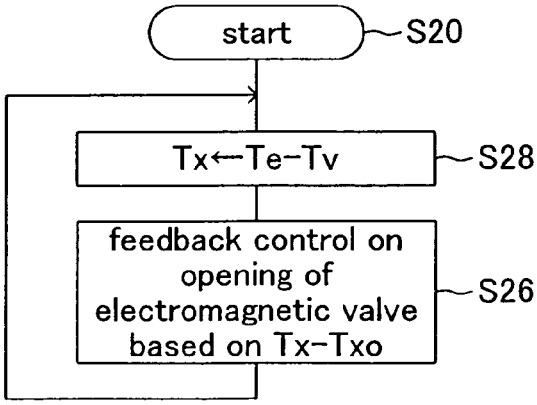
FIG. 9 is a flowchart of a program executed by the controller shown in FIG. 6 according to a modified example of the third embodiment of the present invention.

Furthermore, the third embodiment may be modified to replace the pressure sensor 73 with a temperature sensor 74 for sensing a refrigerant temperature Tv at the inlet of the evaporator 15 as shown in broken lines in FIG. 6. In this modification, instead of the program shown in FIG. 7, the controller 42 repeatedly executes a program shown in FIG. 9. In the program of FIG. 9, steps S22 and S24 of the program in FIG. 7 are replaced with step S28. This replacement is done, considering that a refrigerant temperature Tv at the inlet of the evaporator 15 is approximately equal to a saturation temperature Ts. At the process of step S28 there is obtained a degree of superheat Tx which is similar to that obtained in the third embodiment. The process of step S26 is performed as in the case of the third embodiment. As a result, this modification also achieves the same effect as the third embodiment.

In addition, the third embodiment may also be modified, as shown in broken lines in FIG. 6, to have the ambient temperature sensor 51 or water temperature sensor 52 which are employed in the first embodiment. In this modification, the controller 42 performs control such that the specified degree of superheat Txo decreases with increase in an ambient temperature or water temperature sensed by the ambient temperature sensor 51 or water temperature sensor 52. Due to this control, the area in the evaporator 15 where liquid refrigerant remains increases with increase in ambient temperature or water temperature, which imparts enhanced ice-making performance to the freezing apparatus 10. Even when a rise or drop in ambient temperature or water temperature cannot be overcome by the control of refrigerant flow through the use of the electromagnetic valve 72 performed in the third embodiment, therefore, this modification enables the freezing apparatus 10 to maintain specified ice-making performance, keeping the quality of ice to be generated consistent.

Furthermore, the third embodiment may be modified, as shown in broken lines in FIG. 6, to have the current sensor 53 which is employed in the first embodiment. The controller 42 then controls such that the specified degree of superheat Txo increases with increase in the motor current sensed by the current sensor 53. The current flowing into the auger motor 25 increases when an excessive amount of ice is generated due to an excessively low ambient temperature or excessively low temperature of water supplied to the freezing cylinder 21, for example. In this case, therefore, when an excessive amount of ice is generated, ice-making performance of the freezing apparatus 10 is degraded. Even when excessive generation of ice cannot be overcome by the control of refrigerant flow through the use of the electromagnetic valve 72, therefore, this modification can keep the ice-making performance of the freezing apparatus 10 within specified performance, maintaining consistent quality of ice to be generated.

Furthermore, the third embodiment may also be modified, as shown in broken lines in FIG. 6, to have the torque sensor 54 or distortion sensor 55 which are employed in the first embodiment. The controller 42 then controls such that the specified degree of superheat Txo increases with increase in the torque or distortion sensed by the torque sensor 54 or distortion sensor 55. In these cases as well as the case of the current flowing into the auger motor 25, when an excessive amount of ice is generated due to an excessively low ambient temperature or excessively low temperature of water supplied to the freezing cylinder 21, for example, the torque sensed by the torque sensor 54 or the distorted amount sensed by the distortion sensor 55 increases.

In these cases as well, therefore, when an excessive amount of ice is generated, ice-making performance of the freezing apparatus 10 is degraded. Even when excessive generation of ice cannot be overcome by the control of refrigerant flow through the use of the electromagnetic valve 72, therefore, these modifications can keep the ice-making performance of the freezing apparatus 10 within specified performance, maintaining consistent quality of ice to be generated. Furthermore, these modifications can avoid a heavy load applied to the auger motor 25 which drives the ice-scraping auger 23 and a significant thrust exerted on the blade of the ice-scraping auger 23, resolving the problem of ice clogging caused by increased resistance applied to the spiral blade 23*a* of the ice-scraping auger 23 at the passage of ice to make such ice making machine failure-resistant.

Furthermore, the third embodiment may be modified, as shown in broken lines in FIG. 6, to have the performance inputting device 56 which is employed in the first embodiment. The controller 42 then sets a specified degree of superheat Txo in accordance with the performance of the freezing apparatus 10 input with the performance inputting device 56. In this case, the performance inputting device 56 may allow a user to input the level of the performance in making ice, the degree of superheat, etc. The resulting modified example having the performance inputting device 56 enables the user to arbitrarily designate a degree of superheat Txo of refrigerant in the evaporator 15. As described above, therefore, the user can vary the area where refrigerant can make ice in the evaporator 15 to extensively vary the ice-making performance of the freezing apparatus, responding, with facility, to changes in demand for ice in accordance with season, circumstances, or the like.

Described above are the first to third embodiments of the present invention and their modified examples. In carrying out the present invention, it will be understood that the present invention is not limited to the above-described embodiments and their modifications, but various modifications may be made without departing from the spirit and scope of the invention.

The invention claimed is:

1. An auger type ice making machine provided with a freezing cylinder which has an evaporator on its outer peripheral surface and into which water used for making ice is supplied, an ice-scraping auger for scraping ice formed on an inner surface of the freezing cylinder, an auger motor for driving the ice-scraping auger, a freezing apparatus which includes a compressor, a condenser and the evaporator and circulates refrigerant discharged from the compressor through the condenser and the evaporator to cool the freezing cylinder, and a motor which drives the compressor, the auger type ice making machine comprising:

pressure regulating means for keeping the pressure of refrigerant to be supplied to the evaporator at a specified low pressure;

an outlet temperature sensor for sensing refrigerant temperature at an outlet of the evaporator;

motor controlling means for controlling the rotational speed of the motor that drives the compressor in response to the refrigerant temperature at the outlet of the evaporator sensed by the outlet temperature sensor and thereby performing feedback control such that the refrigerant temperature at the outlet of the evaporator is kept at a specified refrigerant outlet temperature, resulting in the degree of superheat of refrigerant in the evaporator being kept at a predetermined constant value;

a water temperature sensor for sensing temperature of water to be supplied to the freezing cylinder; and refrigerant outlet temperature change controlling means for decreasing the specified refrigerant outlet temperature as the sensed water temperature rises.

2. An auger type ice making machine according to claim 1, wherein the pressure regulating means comprises a constant pressure expansion valve which is interposed between the condenser and the evaporator, and whose opening is controlled and changed in response to the refrigerant pressure on a downstream side of the interposed position.

3. An auger type ice making machine according to claim 1, wherein the pressure regulating means comprises:

a variable control valve being interposed between the condenser and the evaporator; the opening of the variable control valve being electrically controlled and changed;

a pressure sensor for sensing refrigerant pressure at an inlet of the evaporator; and opening controlling means for controlling the opening of the variable control valve in response to the refrigerant pressure sensed by the pressure sensor and thereby keeping the pressure of refrigerant to be supplied to the evaporator at a specified low pressure.

4. An auger type ice making machine according to claim 1, wherein the pressure regulating means comprises:

a variable control valve being interposed between the condenser and the evaporator; the opening of the variable control valve being electrically controlled and changed;

an inlet temperature sensor for sensing refrigerant temperature at an inlet of the evaporator; and opening controlling means for controlling the opening of the variable control valve in response to the refrigerant temperature sensed by the inlet temperature sensor and thereby keeping the pressure of refrigerant to be supplied to the evaporator at a specified low pressure.

5. An auger type ice making machine according to claim 1, wherein the freezing cylinder is placed vertically along the axis thereof, receives water for making ice at a lower part thereof and discharges scrapped ice from an upper part thereof;

the evaporator is provided on the outer peripheral surface of the freezing cylinder, ranging from the upper part to the lower part of the freezing cylinder; and the inlet of the evaporator into which refrigerant flows is placed at the upper part of the freezing cylinder.

6. An auger type ice making machine provided with a freezing cylinder which has an evaporator on its outer peripheral surface and into which water used for making ice is supplied, an ice-scraping auger for scraping ice formed on an inner surface of the freezing cylinder, an auger motor for driving the ice-scraping auger, a freezing apparatus which includes a compressor, a condenser and the evaporator and circulates refrigerant discharged from the compressor through the condenser and the evaporator to cool the freezing cylinder, and a motor which drives the compressor, the auger type ice making machine comprising:

pressure regulating means for keeping the pressure of refrigerant to be supplied to the evaporator at a specified low pressure;

an outlet temperature sensor for sensing refrigerant temperature at an outlet of the evaporator;

motor controlling means for controlling the rotational speed of the motor that drives the compressor in response to the refrigerant temperature at the outlet of the evaporator sensed by the outlet temperature sensor and thereby performing feedback control such that the refrigerant temperature at the outlet of the evaporator is kept at a specified refrigerant outlet temperature, resulting in the degree of superheat of refrigerant in the evaporator being kept at a predetermined constant value;

a current sensor for sensing current flowing into the auger motor; and refrigerant outlet temperature change controlling means for increasing the specified refrigerant outlet temperature as the sensed current increases.

7. An auger type ice making machine according to claim 6, wherein the pressure regulating means comprises a constant pressure expansion valve which is interposed between the condenser and the evaporator, and whose opening is controlled and changed in response to the refrigerant pressure on a downstream side of the interposed position.

8. An auger type ice making machine according to claim 6, wherein the pressure regulating means comprises:

a variable control valve being interposed between the condenser and the evaporator; the opening of the variable control valve being electrically controlled and changed;

a pressure sensor for sensing refrigerant pressure at an inlet of the evaporator; and opening controlling means for controlling the opening of the variable control valve in response to the refrigerant pressure sensed by the pressure sensor and thereby keeping the pressure of refrigerant to be supplied to the evaporator at a specified low pressure.

9. An auger type ice making machine according to claim 6, wherein the pressure regulating means comprises:

a variable control valve being interposed between the condenser and the evaporator; the opening of the variable control valve being electrically controlled and changed;

an inlet temperature sensor for sensing refrigerant temperature at an inlet of the evaporator; and opening controlling means for controlling the opening of the variable control valve in response to the refrigerant temperature sensed by the inlet temperature sensor and thereby keeping the pressure of refrigerant to be supplied to the evaporator at a specified low pressure.

10. An auger type ice making machine according to claim 6, wherein the freezing cylinder is placed vertically along the axis thereof, receives water for making ice at a lower part thereof and discharges scrapped ice from an upper part thereof;

the evaporator is provided on the outer peripheral surface of the freezing cylinder, ranging from the upper part to the lower part of the freezing cylinder; and the inlet of the evaporator into which refrigerant flows is placed at the upper part of the freezing cylinder.

11. An auger type ice making machine provided with a freezing cylinder which has an evaporator on its outer peripheral surface and into which water used for making ice is supplied, an ice-scraping auger for scraping ice formed on an inner surface of the freezing cylinder, an auger motor for driving the ice-scraping auger, a freezing apparatus which includes a compressor, a condenser and the evaporator and circulates refrigerant discharged from the compressor through the condenser and the evaporator to cool the freezing cylinder, and a motor which drives the compressor, the auger type ice making machine comprising:

pressure regulating means for keeping the pressure of refrigerant to be supplied to the evaporator at a specified low pressure;

an outlet temperature sensor for sensing refrigerant temperature at an outlet of the evaporator;

motor controlling means for controlling the rotational speed of the motor that drives the compressor in response to the refrigerant temperature at the outlet of the evaporator sensed by the outlet temperature sensor and thereby performing feedback control such that the refrigerant temperature at the outlet of the evaporator is kept at a specified refrigerant outlet temperature, resulting in the degree of superheat of refrigerant in the evaporator being kept at a predetermined constant value;

a torque sensor for sensing torque transmitted from the auger motor to the ice-scraping auger; and refrigerant outlet temperature change controlling means for increasing the specified refrigerant outlet temperature as the sensed torque increases.

12. An auger type ice making machine according to claim 11, wherein the pressure regulating means comprises a constant pressure expansion valve which is interposed between the condenser and the evaporator, and whose opening is controlled and changed in response to the refrigerant pressure on a downstream side of the interposed position.

13. An auger type ice making machine according to claim 11, wherein the pressure regulating means comprises:

a variable control valve being interposed between the condenser and the evaporator; the opening of the variable control valve being electrically controlled and changed;

a pressure sensor for sensing refrigerant pressure at an inlet of the evaporator; and opening controlling means for controlling the opening of the variable control valve in response to the refrigerant pressure sensed by the pressure sensor and thereby keeping the pressure of refrigerant to be supplied to the evaporator at a specified low pressure.

14. An auger type ice making machine according to claim 11, wherein the pressure regulating means comprises:

a variable control valve being interposed between the condenser and the evaporator; the opening of the variable control valve being electrically controlled and changed;

an inlet temperature sensor for sensing refrigerant temperature at an inlet of the evaporator; and opening controlling means for controlling the opening of the variable control valve in response to the refrigerant temperature sensed by the inlet temperature sensor and thereby keeping the pressure of refrigerant to be supplied to the evaporator at a specified low pressure.

15. An auger type ice making machine according to claim 11, wherein the freezing cylinder is placed vertically along the axis thereof, receives water for making ice at a lower part thereof and discharges scrapped ice from an upper part thereof;

the evaporator is provided on the outer peripheral surface of the freezing cylinder, ranging from the upper part to the lower part of the freezing cylinder; and the inlet of the evaporator into which refrigerant flows is placed at the upper part of the freezing cylinder.

16. An auger type ice making machine provided with a freezing cylinder which has an evaporator on its outer peripheral surface and into which water used for making ice is supplied, an ice-scraping auger for scraping ice formed on an inner surface of the freezing cylinder, an auger motor for driving the ice-scraping auger, a freezing apparatus which includes a compressor, a condenser and the evaporator and circulates refrigerant discharged from the compressor through the condenser and the evaporator to cool the freezing cylinder, and a motor which drives the compressor, the auger type ice making machine comprising:

pressure regulating means for keeping the pressure of refrigerant to be supplied to the evaporator at a specified low pressure;

an outlet temperature sensor for sensing refrigerant temperature at an outlet of the evaporator;

motor controlling means for controlling the rotational speed of the motor that drives the compressor in response to the refrigerant temperature at the outlet of the evaporator sensed by the outlet temperature sensor and thereby performing feedback control such that the refrigerant temperature at the outlet of the evaporator is kept at a specified refrigerant outlet temperature, resulting in the degree of superheat of refrigerant in the evaporator being kept at a predetermined constant value;

a distortion sensor for sensing distorted amount of the freezing cylinder; and refrigerant outlet temperature change controlling means for increasing the specified refrigerant outlet temperature as the sensed distorted amount increases.

17. An auger type ice making machine according to claim 16, wherein the pressure regulating means comprises a constant pressure expansion valve which is interposed between the condenser and the evaporator, and whose opening is controlled and changed in response to the refrigerant pressure on a downstream side of the interposed position.

18. An auger type ice making machine according to claim 16, wherein the pressure regulating means comprises:

a variable control valve being interposed between the condenser and the evaporator; the opening of the variable control valve being electrically controlled and changed;

a pressure sensor for sensing refrigerant pressure at an inlet of the evaporator; and opening controlling means for controlling the opening of the variable control valve in response to the refrigerant pressure sensed by the pressure sensor and thereby keeping the pressure of refrigerant to be supplied to the evaporator at a specified low pressure.

19. An auger type ice making machine according to claim 16, wherein the pressure regulating means comprises:

a variable control valve being interposed between the condenser and the evaporator; the opening of the variable control valve being electrically controlled and changed;

an inlet temperature sensor for sensing refrigerant temperature at an inlet of the evaporator; and opening controlling means for controlling the opening of the variable control valve in response to the refrigerant temperature sensed by the inlet temperature sensor and thereby keeping the pressure of refrigerant to be supplied to the evaporator at a specified low pressure.

20. An auger type ice making machine according to claim 16, wherein the freezing cylinder is placed vertically along the axis thereof, receives water for making ice at a lower part thereof and discharges scrapped ice from an upper part thereof;

the evaporator is provided on the outer peripheral surface of the freezing cylinder, ranging from the upper part to the lower part of the freezing cylinder; and the inlet of the evaporator into which refrigerant flows is placed at the upper part of the freezing cylinder.

* * * * *